US008059039B2

(12) United States Patent
Ayala Vazquez et al.

(10) Patent No.: US 8,059,039 B2
(45) Date of Patent: Nov. 15, 2011

(54) CLUTCH BARREL ANTENNA FOR WIRELESS ELECTRONIC DEVICES

(75) Inventors: Enrique Ayala Vazquez, Watsonville, CA (US); Hao Xu, Cupertino, CA (US); Gregory A. Springer, Sunnyvale, CA (US); Bing Chiang, Cupertino, CA (US); Eduardo Lopez Camacho, Watsonville, CA (US); Douglas B. Kough, San Jose, CA (US)

(73) Assignee: Apple Inc., Cupertino, CA (US)

( * ) Notice: Subject to any disclaimer, the term of this patent is extended or adjusted under 35 U.S.C. 154(b) by 429 days.

(21) Appl. No.: 12/238,385

(22) Filed: Sep. 25, 2008

(65) Prior Publication Data

US 2010/0073242 A1 Mar. 25, 2010

(51) Int. Cl.
*H01Q 1/24* (2006.01)

(52) U.S. Cl. ..... 343/702; 343/767

(58) Field of Classification Search ..... 343/702, 343/700 MS, 767, 770
See application file for complete search history.

(56) References Cited

U.S. PATENT DOCUMENTS

| | | | | |
|---|---|---|---|---|
| 5,258,892 | A | 11/1993 | Stanton et al. | |
| 5,608,413 | A * | 3/1997 | Macdonald | 343/700 MS |
| 6,272,356 | B1 * | 8/2001 | Dolman et al. | 455/575.3 |
| 6,392,610 | B1 | 5/2002 | Braun et al. | |
| 6,414,643 | B2 | 7/2002 | Cheng et al. | |
| 6,421,029 | B1 | 7/2002 | Tanabe | |
| 6,448,942 | B2 | 9/2002 | Weinberger et al. | |
| 6,539,608 | B2 | 4/2003 | McKinnon et al. | |
| 6,570,538 | B2 | 5/2003 | Vaisanen et al. | |
| 6,667,719 | B2 * | 12/2003 | LaKomski | 343/702 |
| 6,781,546 | B2 * | 8/2004 | Wang et al. | 343/700 MS |
| 6,847,329 | B2 * | 1/2005 | Ikegaya et al. | 343/702 |
| 7,345,646 | B1 | 3/2008 | Lin et al. | |
| 7,705,789 | B2 * | 4/2010 | Suzuki et al. | 343/702 |
| 2001/0040529 | A1 * | 11/2001 | Cheng et al. | 343/702 |

(Continued)

OTHER PUBLICATIONS

R. Bancroft "A Commercial Perspective on the Development and Integration of an 802_11a/big HiperLanNVLAN Antenna into Laptop Computers", IEEE Antennas and Propagation Magazine, vol. 48, No. 4, Aug. 2006, pp. 12-18.*

(Continued)

*Primary Examiner* — Hoanganh Le
(74) *Attorney, Agent, or Firm* — Treyz Law Group; G. Victor Treyz; David C. Kellogg

(57) ABSTRACT

Wireless portable electronic devices such as laptop computers are provided with antennas. An antenna may be provided within a clutch barrel in a laptop computer. The clutch barrel may have a dielectric cover. Antenna elements may be mounted within the clutch barrel cover on an antenna support structure. There may be two or more antenna elements mounted to the antenna support structure. These antenna elements may be of different types. A first antenna element for the clutch barrel antenna may be formed from a dual band antenna element having a closed slot and an open slot. A second antenna element for the clutch barrel antenna may be formed from a dual band antenna element of a hybrid type having a planar resonating element arm and a slot resonating element. Flex circuit structures may be used in implanting the first and second antenna elements for the clutch barrel antenna.

18 Claims, 13 Drawing Sheets

U.S. PATENT DOCUMENTS

| | | | | |
|---|---|---|---|---|
| 2003/0222823 | A1* | 12/2003 | Flint et al. | 343/702 |
| 2004/0257283 | A1* | 12/2004 | Asano et al. | 343/702 |
| 2006/0158379 | A1 | 7/2006 | Ishimiya | |
| 2007/0126651 | A1 | 6/2007 | Snyder et al. | |
| 2007/0140072 | A1 | 6/2007 | Agrawal et al. | |
| 2009/0153411 | A1* | 6/2009 | Chiang et al. | 343/702 |
| 2009/0273529 | A1* | 11/2009 | Liu | 343/725 |

OTHER PUBLICATIONS

U.S. Appl. No. 12/142,744, filed Jun. 19, 2008, Ayala et al.

"AirPort Product-Specific Details", AirPort Developer Note, [Online], Updated: Apr. 28, 2008, Retrieved: Sep. 25, 2008, <http://developer.apple.com/documentation/HardwareDrivers/Conceptual/HWTech_Airport/Articles/AirP_implementation.html>.

* cited by examiner

CLUTCH BARREL ANTENNA FOR WIRELESS ELECTRONIC DEVICES

BACKGROUND

This invention relates to wireless electronic devices, and more particularly, to antennas for wireless electronic devices such as portable electronic devices.

Antennas are used in conjunction with a variety of electronic devices. For example, computers use antennas to support wireless local area network communications. Antennas are also used for long-range wireless communications in cellular telephone networks.

It can be difficult to design antennas for modern electronic devices, particularly in electronic devices in which compact size and pleasing aesthetics are important. If an antenna is too small or is not designed properly, antenna performance may suffer. At the same time, an overly-bulky antenna or an antenna with an awkward shape may detract from the appearance of an electronic device or may make the device larger than desired.

It would therefore be desirable to be able to provide improved antennas for electronic devices such as portable electronic devices.

SUMMARY

Wireless portable electronic devices such as laptop computers are provided with antennas that fit into the confines of a compact portion of the laptop computer housing. The compact portion of the laptop computer housing may be associated with a hinge. A laptop computer of other portable wireless electronic device may have first and second housing portions that are attached at a hinge structure. The hinge structure may allow the top of a laptop computer to rotate relative to the base of a laptop computer.

The hinge structure may have an associated clutch barrel that houses springs and other hinge components. Clutch barrel components may be covered using a plastic clutch barrel cover. The plastic clutch barrel cover may run along the intersection between the upper lid and base portion of a laptop computer.

An antenna support structure may be mounted within the clutch barrel cover. Antenna elements such as flex circuit antenna elements may be mounted on the antenna support structure.

Particularly in communications environments in which it is desirable to support multiple-input-multiple-output (MIMO) applications, it may be desirable to form an antenna such as a clutch barrel antenna from multiple antenna elements of different types. This type of configuration helps to improve overall antenna performance due to the differing performance characteristics of each of the antenna elements. Antenna elements of different types may, for example, have different polarizations and may exhibit different gain patterns. A clutch barrel antenna that is formed from two or more antenna elements of different types may exhibit reduced directivity and enhanced performance relative to a clutch barrel antenna that is formed from identical antenna elements.

With one suitable arrangement, a first antenna element for a clutch barrel antenna is formed using a dual band slot antenna. The dual band slot antenna may have two slots. One of the slots may be an open slot and the other slot may be a closed slot. The lengths of the slots may be different and may be selected to support communications in respective first and second communications bands. A second antenna element in the same clutch barrel antenna may be formed using a second dual band antenna that operates in the first and second communications bands. The second antenna element may be of a hybrid type that has a planar antenna resonating element arm and a slot antenna resonating element.

Further features of the invention, its nature and various advantages will be more apparent from the accompanying drawings and the following detailed description of the preferred embodiments.

DETAILED DESCRIPTION

The present invention relates to antennas for wireless electronic devices. The wireless electronic devices may, in general, be any suitable electronic devices. As an example, the wireless electronic devices may be desktop computers or other computer equipment. The wireless electronic devices may also be portable electronic devices such as laptop computers or small portable computers of the type that are sometimes referred to as ultraportables. Portable wireless electronic devices may also be somewhat smaller devices. Examples of smaller portable electronic devices include wrist-watch devices, pendant devices, headphone and earpiece devices, other wearable and miniature devices, and handheld electronic devices. The portable electronic devices may be cellular telephones, media players with wireless communications capabilities, handheld computers (also sometimes called personal digital assistants), remote controls, global positioning system (GPS) devices, and handheld gaming devices. Devices such as these may be multifunctional. For example, a cellular telephone may be provided with media player functionality or a tablet personal computer may be provided with the functions of a remote control or GPS device.

Portable electronic devices such as these may have housings. Arrangements in which antennas are incorporated into the clutch barrel housing portion of portable computers such as laptops are sometimes described herein as an example. This is, however, merely illustrative. Antennas in accordance with embodiments of the present invention may be located in any suitable housing portion in any suitable wireless electronic device.

Figure 1:
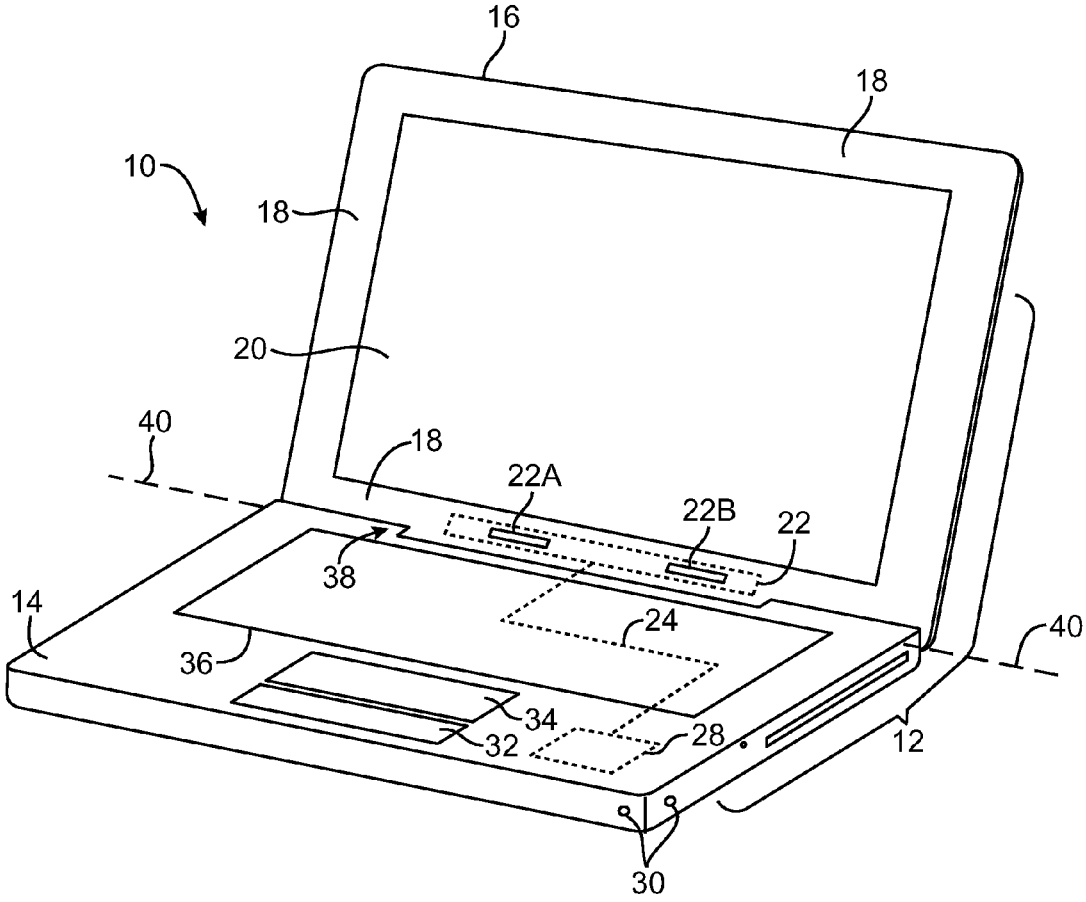
FIG. 1 is a perspective view of an illustrative wireless electronic device such as a laptop computer that may be provided with antenna structures in accordance with an embodiment of the present invention.

An illustrative electronic device such as a portable electronic device in accordance with an embodiment of the present invention is shown in FIG. 1. Device 10 may be any suitable electronic device. As an example, device 10 may be a laptop computer.

As shown in FIG. 1, device 10 may have a housing 12. Housing 12, which is sometimes referred to as a case, may have an upper portion such as portion 16 and lower portion such as portion 14. Upper housing portion 16 may sometimes be referred to as a cover or lid. Lower housing portion 14 may sometimes be referred to as a base.

Device 10 may be provided with any suitable number of antennas. There may be, for example, one antenna, two antennas, three antennas, or more than three antennas, in device 10. Each antenna may handle communications over a single communications band or multiple communications bands. In the example of FIG. 1, device 10 is shown as including an antenna such as antenna 22.

Device 10 may have integrated circuits such as a microprocessor. Integrated circuits may also be included in device 10 for memory, input-output functions, etc. Circuitry in device 10 such as integrated circuits and other circuit components may be located in lower housing portion 14. For example, a main logic board (sometimes referred to as a motherboard) may be used to mount some or all of this circuitry. The main logic board circuitry may be implemented using a single printed circuit board or multiple printed circuit boards. Printed circuit boards in device 10 may be formed from rigid printed circuit board materials or flexible printed circuit board materials. An example of a rigid printed circuit board material is fiberglass filled epoxy. An example of a flexible printed circuit board material is polyimide. Flexible printed circuit board structures may be used for mounting integrated circuits and other circuit components and may be used to form communications pathways in device 10. Flexible printed circuit board structures such as these are sometimes referred to as "flex circuits."

If desired, wireless communications circuitry for supporting operations with antenna 22 may be mounted on a radio-frequency module associated with antenna 22. As shown in FIG. 1, a communications path such as path 24 may be used to interconnect antenna 22 to circuitry 28 in lower housing portion 14. Path 24 may be implemented, for example, using a flex circuit that is connected to a radio-frequency antenna module associated with antenna 22. Circuitry 28 may include wireless communications circuitry and other processing circuitry. This circuitry may be associated with a main logic board (motherboard) in lower housing 14 (as an example). Analog radio-frequency antenna signals and/or digital data associated with antenna 22 may be conveyed over path 24. An advantage to locating radio-frequency circuitry in the immediate vicinity of antenna 22 is that this allows data to be conveyed between the motherboard in housing portion 14 and antenna 22 digitally without incurring radio-frequency transmission line losses along path 24.

Device 10 may use antennas such as antenna 22 to handle communications over any communications bands of interest. For example, antennas and wireless communications circuitry in device 10 may be used to handle cellular telephone communications in one or more frequency bands and data communications in one or more communications bands. Typical data communications bands that may be handled by the wireless communications circuitry in device 10 include the 2.4 GHz band that is sometimes used for Wi-Fi® (IEEE 802.11) and Bluetooth® communications, the 5 GHz band that is sometimes used for Wi-Fi communications, the 1575 MHz Global Positioning System band, and 2G and 3G cellular telephone bands. These bands may be covered using single-band and multiband antennas. For example, cellular telephone communications can be handled using a multiband cellular telephone antenna. A single band antenna may be provided to handle Bluetooth® communications. Antenna 22 may, as an example, be a multiband antenna that handles local area network data communications at 2.4 GHz and 5 GHz (e.g., for IEEE 802.11 communications). These are merely examples. Any suitable antenna structures may be used to cover any communications bands of interest.

As shown in FIG. 1, a hinge mechanism such as hinge 38 may be used to attach cover 16 to base 14. Hinge 38 may allow cover 16 to rotate relative to base 14 about longitudinal hinge axis 40. If desired, other attachment mechanisms may be used such as a rotating and pivoting hinge for a tablet computer. Device 10 may also be implemented using a one-piece housing. In devices with two-piece housings, the hinge portion of the device may contain springs that form a clutch mechanism and may therefore sometimes be referred to as a clutch barrel. Antenna 22 may, if desired, be located within clutch barrel 38.

Device 10 may have a display such as display 20. Display 20 may be, for example, a liquid crystal display (LCD), an organic light emitting diode (OLED) display, or a plasma display (as examples). If desired, touch screen functionality may be incorporated into display 20. The touch screen may be responsive to user input.

Device 10 may also have other input-output devices such as keypad 36, touch pad 34, and buttons such as button 32. Input-output jacks and ports 30 may be used to provide an interface for accessories such as a microphone and headphones. A microphone and speakers may also be incorporated into housing 12.

The edges of display 20 may be surrounded by a bezel 18. Bezel 18 may be formed from a separate bezel structure such as a plastic ring or may be formed as an integral portion of a cover glass layer that protects display 20. For example, bezel 18 may be implemented by forming an opaque black glass portion for display 20 or an associated cover glass piece. This type of arrangement may be used, for example, to provide upper housing 16 with an attractive uncluttered appearance.

When cover 16 is in a closed position, display 20 will generally lie flush with the upper surface of lower housing 14. In this position, magnets on cover 16 may help hold cover 16 in place. Magnets may be located, for example, behind bezel portion 18.

Housing 12 may be formed from any suitable materials such as plastics, metals, glass, ceramic, carbon fiber, composites, combinations of plastic and metal, etc. To provide good durability and aesthetics, it is often desirable to use metal to form at least the exterior surface layer of housing 12. Interior portions such as frames and other support members may be formed from plastic in areas where light weight and radio-frequency transparency are desired and may be formed from metal in areas where good structural strength is desirable. In configurations in which an antenna such as antenna 22 is located in clutch barrel 38, it may be desirable to form the cover portion of clutch barrel 38 from a dielectric such as plastic, as this allows radio-frequency signals to freely pass between the interior and exterior of the clutch barrel.

Particularly in devices in which cover 16 and lower housing portion 14 are formed from metal, it can be challenging to properly locate antenna structures. Antenna structures that are blocked by conductive materials such as metal will not generally function properly. An advantage of locating at least some of the antenna structures for device 10 in clutch barrel 38 is that this portion of device 10 can be provided with a dielectric cover without adversely affecting the aesthetics of device 10. There is generally also sufficient space available within a laptop clutch barrel for an antenna, because it can be difficult to mount other device components into this portion of device 10. By properly positioning antenna resonating elements within the clutch barrel, nearby conductive metal portions of the upper device housing 16 and lower device housing 14 may serve as antenna ground.

If desired, device 10 may be provided with multiple antennas. For example, an antenna for wireless local area network applications (e.g., IEEE 802.11) may be provided within clutch barrel 38 while a Bluetooth® antenna may be formed from a conductive cavity that is located behind bezel region 18 (as an example). Additional antennas may be used to support cellular telephone network communications (e.g., for 2G and 3G voice and data services) and other communications bands.

An antenna such as a clutch barrel antenna may be formed from a single antenna element. In some situations, it may be advantageous to form antennas for devices such as device 10 using multiple antenna elements. For example, a clutch barrel antenna may be formed from two antenna elements, three antenna elements, more than three antenna elements, etc. Antennas such as these are sometimes referred to as antenna arrays, antenna structures, antenna systems, or multielement antennas.

As an example, a clutch barrel antenna may be formed from first and second antenna elements. The first and second antenna elements may be arranged at different positions along longitudinal axis 40 of clutch barrel 38. This type of configuration is shown in FIG. 1. As shown in FIG. 1, antenna 22 may be formed from a first antenna element such as antenna element 22A and a second antenna element 22B. Each of these antenna elements may, if desired, serve as a stand-alone antenna. Because these elements are typically used in applications in which they work together as part of a larger antenna array, antennas such as antennas 22A and 22B are sometimes referred to herein as antenna elements, antenna systems, or antenna structures.

The antenna structures of antenna 22 include resonating element portions and ground portions. In devices 10 in which case 12 is conductive, portions of case 12 may serve as antenna ground and therefore operate as part of antenna 22.

Antennas that are formed from multiple antenna elements such as elements 22A and 22B may be used, for example, to implement multiple-input-multiple-output (MIMO) applications. Particularly in arrangements such as these, it may be desirable to form antennas that are not identical. Differences in polarization, gain, spatial location, and other characteristics may help these antennas operate well in an array. Differences such as these may also help to balance the operation of the overall antenna that is formed from the elements. For example, if antenna elements 22A and 22B have electric field polarizations that are distributed differently, the overall directivity of antenna 22 may be minimized. If antennas are too directive in nature, they may not function properly for certain applications. Antennas formed from elements 22A and 22B that exhibit different antenna characteristics may exhibit reduced directivity, allowing these antennas to be used in desired applications while complying with regulatory limits.

Antenna elements that exhibit desired differences in their operating characteristics such as their electric-field polarization distribution and gain distribution may be formed by ensuring that the sizes and shapes of the conductive elements that make up each of antenna elements are sufficiently different from each other. Antenna element differences may also be implemented by using different dielectric loading schemes for each of the elements. Antenna elements may also be made to perform differently by orienting elements differently (e.g., at right angles to each other).

In some situations, it may be desirable to ensure that antenna elements operate differently from each other by implementing the antenna elements using different antenna designs. For example, one antenna element may be implemented using a planar inverted-F antenna design and another antenna may be implemented using a slot antenna architecture. The use different antenna types such as these for the antenna elements in antenna 22 (e.g., for antenna elements 22A and 22B), can help to ensure that antenna 22 will exhibit satisfactory performance (e.g., in applications such as MIMO applications that benefit from an array of antennas that are not too similar in location and operating characteristics).

Figure 2:
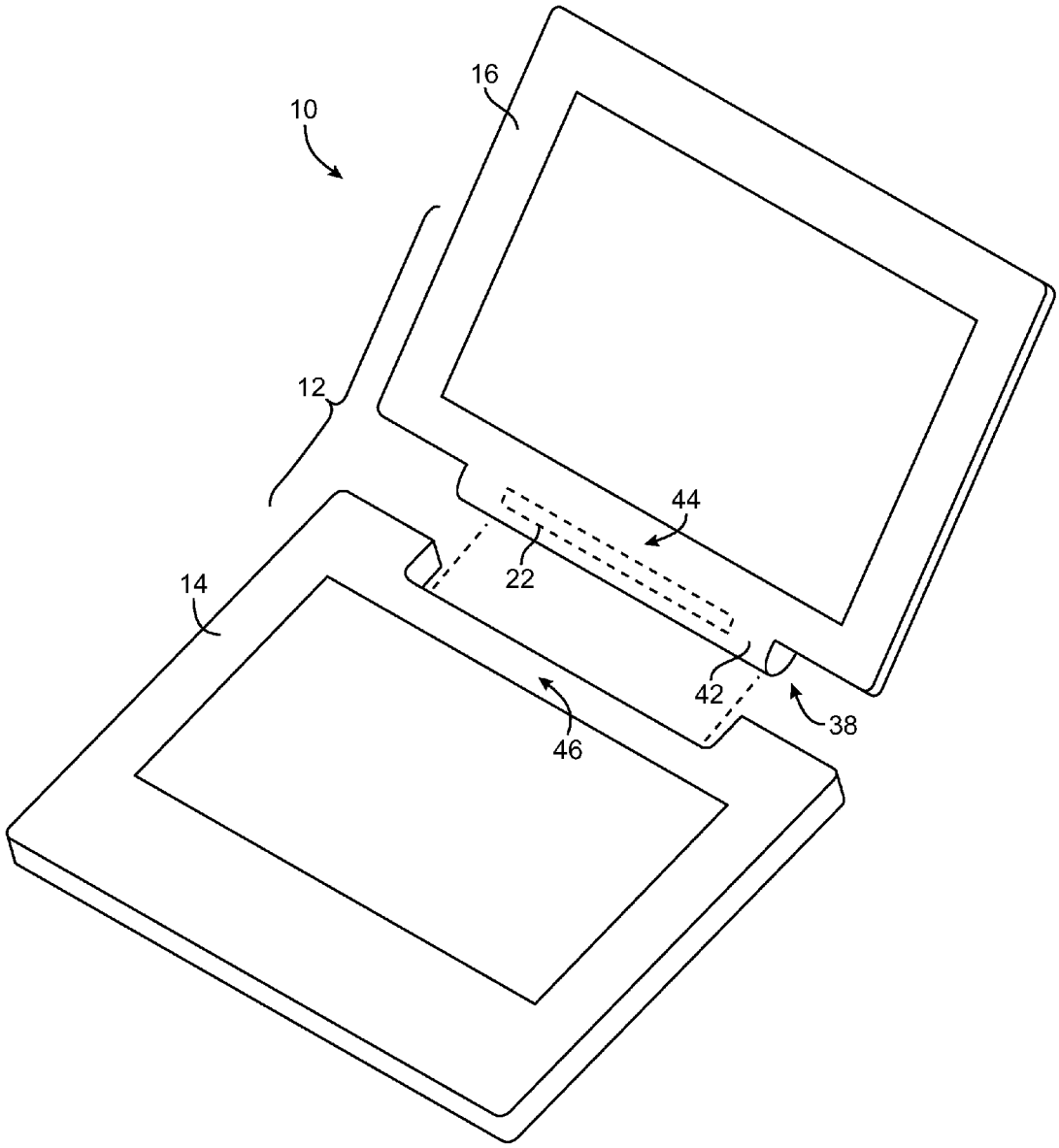
FIG. 2 is an exploded perspective view of an illustrative laptop computer having a housing portion such as a clutch barrel in which antenna structures may be located in accordance with an embodiment of the present invention.

As described in connection with FIG. 1, antenna 22 may be located in the clutch barrel portion of a portable computer. As shown in the exploded diagram of FIG. 2, clutch barrel 38 of device 10 may be provided with outer surface 42. Outer surface 42 may be formed entirely or partly from a dielectric such as plastic. This type of arrangement may be used to ensure that outer surface 42 does not block radio-frequency antenna signals. Nearby portions of device 10 such as portion 44 of upper housing 16 and portion 46 of lower housing 14 can serve as all or part of the ground for antenna 22.

Clutch barrel cover 42 may be formed from a unitary (one-piece) structure or may be formed from multiple parts. Clutch barrel cover 42 may have any suitable shape. For example, surface 42 may be substantially cylindrical in shape. Surface 42 may also have other shapes such as shapes with planar surfaces, shapes with curved surfaces, shapes with both curved and flat surfaces, etc. In general, the shape for the outer surface of clutch barrel 38 may be selected based on aesthetics, so long as the resulting shape for clutch barrel 38 does not impede rotational movement of upper housing portion 16 relative to lower housing portion 14 about clutch barrel longitudinal axis 40 (FIG. 1).

In general, antenna 22 may be formed from any suitable antenna structures such as stamped or etched metal foil, wires, printed circuit board traces, other pieces of conductor, etc. Conductive structures may be freestanding or may be supported on substrates. Examples of suitable substrates that may be used in forming antenna 22 include rigid printed circuit boards (PCBs) such as fiberglass filled epoxy boards and flexible printed circuits ("flex circuits") such as polyimide sheets. In printed circuit boards and flex circuits, conductive traces may be used in forming antenna structures such as antenna resonating elements, ground structures, impedance matching networks, and feeds. These conductive traces may be formed from conductive materials such as metal (e.g., copper, gold, etc.).

Figure 3:
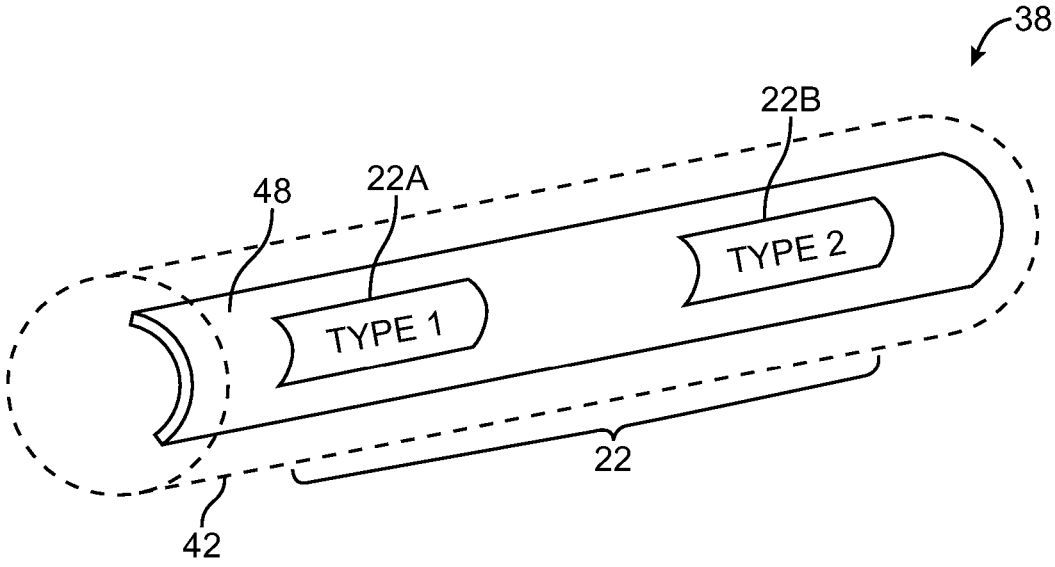
FIG. 3 is a perspective view an illustrative antenna formed from two different types of antenna element within a portable electronic device housing structure such as a clutch barrel in accordance with an embodiment of the present invention.

An advantage of using flex circuits in forming antenna structures is that flex circuits can be inexpensive to manufacture and can be fabricated with accurate trace dimensions. Flex circuits also have the ability to conform to non-planar shapes. This allows flex circuit antenna elements to be formed that curve to follow the curved surface of clutch barrel surface 42. An example is shown in FIG. 3. As shown in FIG. 3, antenna 22 may be formed within portable computer clutch barrel 38 having a clutch barrel cover member 42. Antenna 22 may have an antenna support structure such as antenna support structure 48. Antenna support structure 48 may be formed from plastic, ceramic, other dielectrics, other suitable supporting materials, or combinations of these materials. An advantage to forming support structure 48 from plastic is that plastic is durable, lightweight, and inexpensive to manufacture. If desired, antenna support structure 48 may be configured so that its outermost surface follows the curved inner surface of clutch barrel cover 42. Other shapes may be used if desired (e.g., planar shapes, shapes with flat and curved portions, concave curve surfaces, mixtures of convex, concave, and flat surfaces, etc.).

Antenna 22 may be formed from multiple antenna elements such as antenna elements 22A and 22B. Antenna elements 22A and 22B may be, for example, flex circuits that are mounted to antenna support structure 48 (as an example). In the FIG. 3 example, there are two antenna elements 22A and 22B, but a different number of antenna elements may be used in antenna 22 if desired.

To support MIMO applications, it may be desirable for some or all of the antenna elements in antenna 22 to exhibit different performance characteristics. For example, it may be desirable for elements 22A and 22B to exhibit substantially different polarizations and different gain patterns. With one suitable arrangement, which is described herein as an example, the antenna elements in antenna 22 such as antenna elements 22A and 22B may be formed using antenna elements of different types. Examples of the types of antenna elements that may be used in forming elements such as elements 22A and 22B include inverted-F antenna elements, planar inverted-F antenna (PIFA) elements, open slot antennas, and closed slot antennas. Hybrid antennas may also be formed. For example, a hybrid PIFA-slot antenna or a hybrid inverted-F and slot antenna may be formed.

Figure 4:
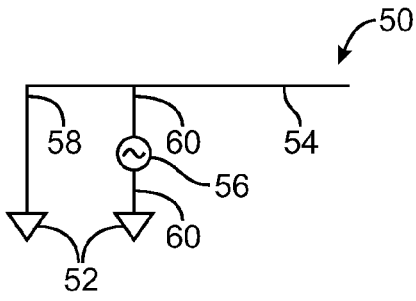
FIG. 4 is a diagram of an illustrative inverted-F antenna element that may be used in an antenna in accordance with an embodiment of the present invention.

An illustrative inverted-F antenna that may be used as one or more of the antenna elements in antenna 22 is shown as antenna 50 in FIG. 4. As shown in FIG. 4, inverted-F antenna 50 may have a main resonating element 54 and shorter paths 58 and 60 that lie between main path 54 and ground 52. Signal source 56 is shown in FIG. 4 to illustrate how antenna 50 may be fed during operation.

In general, the conductive paths that form an antenna element may be formed in any suitable shape (e.g., L-shapes, straight lines, meandering paths, spirals, etc.). In an inverted-F antenna, for example, arm 54 may include a 180° bend (i.e., a fold), 90° bends, acute angle bends, bends that form a meandering path for arm 54, curves, or other suitable shapes. The layout of FIG. 4 in which arm 54 is shown as being straight is merely illustrative.

Figure 5:
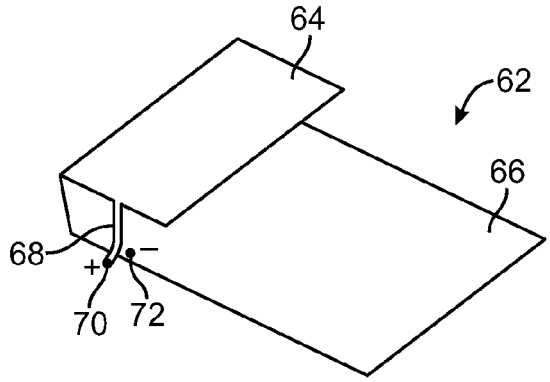
FIG. 5 is a diagram of an illustrative planar inverted-F antenna element that may be used in an antenna in accordance with an embodiment of the present invention.

Another type of antenna design that may be used for one or more of the antenna elements in antenna 22 is a planar inverted-F antenna (PIFA) design. An illustrative PIFA-type antenna is shown in FIG. 5. As shown in FIG. 5, planar inverted-F antenna 62 may have a ground plane 66. Planar antenna resonating element 64 is located above ground plane 66. Antenna 62 may be fed at positive antenna feed terminal 70 and ground feed terminal 72 (as an example). Feed 70 may be electrically connected to planar antenna resonating element 64 by conductive path 68.

Figure 6:
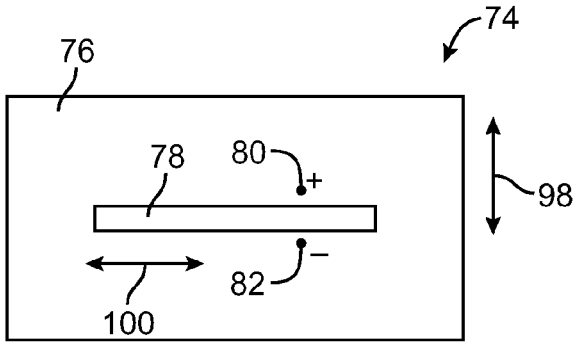
FIG. 6 is a diagram of an illustrative closed slot antenna element that may be used in an antenna in accordance with an embodiment of the present invention.

As shown in FIG. 6, antenna elements in antenna 22 may also be formed using a slot antenna architecture. In the example of FIG. 6, antenna 74 has an elongated rectangular opening in ground plane 76. This elongated opening forms slot 78. Because slot 78 is entirely surrounded by ground plane conductor, this type of slot is sometimes referred to as a "closed" slot. A closed slot typically exhibits its peak frequency resonance at frequencies at which the length of the slot equals a half of a wavelength at the radio-frequency signal frequency of interest. Closed slots such as slot 78 of FIG. 6 may be fed using feed terminals such as terminals 80 and 82 (as an example).

Figure 7:
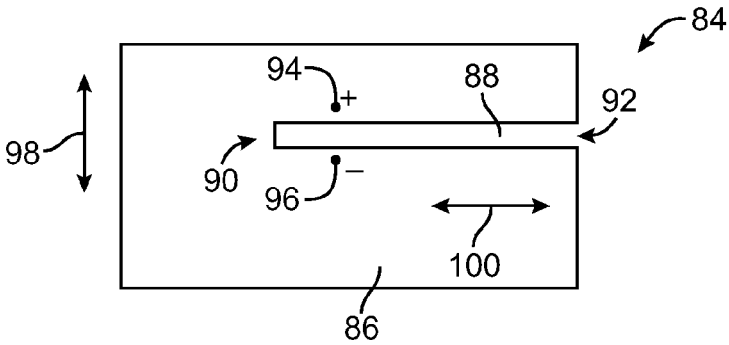
FIG. 7 is a diagram of an illustrative open slot antenna element that may be used in an antenna in accordance with an embodiment of the present invention.

Antenna elements for antenna 22 may also be formed that use open slot antenna architectures. In an open slot configuration, the slot is not surrounded completely by ground plane conductor, but rather has an opening. An illustrative open slot antenna is shown in FIG. 7. As shown in FIG. 7, antenna 84 may have a slot 88. As with antenna slot 78 in the example of FIG. 6, slot 88 is shown as a substantially straight and rectangular opening within its ground plane (i.e., in ground plane 86 in the FIG. 7 example). In general, slot such as slots 78 and 88 may have any suitable shape. For example, slots 78 and 88 may have shapes with curved sides, shapes with bends, circular or oval shapes, non-rectangular polygonal shapes, combinations of these shapes, etc. Slot widths may be measured parallel to lateral dimension 98 and slot lengths may be measured parallel to longitudinal dimension 100. In a typical arrangement, which is shown in FIGS. 6 and 7 as an example, slots 78 and 88 may be substantially straight and rectangular in shape and may have narrower widths (lateral dimensions measured parallel to direction 98) than lengths (longitudinal dimensions measured along direction 100). If desired, however, slots such as slots 78 and 88 may have other shapes (e.g., shapes with non-perpendicular edges, shapes with curved edges, rectangular or non-rectangular shapes with bends, etc.). The use of straight rectangular slot configurations is only an example.

Slots such as slot 88 of FIG. 7 are sometimes referred to as "open" slots because they have one closed end (end 90) and one open end (end 92). At closed end 90, portions of the conductive material that make up ground plane 86 surround slot 88. At open end 92, slot 88 is not surrounded by conductor, but rather is open to free space (e.g. air or other surrounding dielectric). An open slot typically exhibits its peak frequency resonance at frequencies at which the length of the slot equals a quarter of a wavelength at the radio-frequency signal frequency of interest. Open slots such as slot 88 of FIG. 7 may be fed using feed terminals such as terminals 94 and 96 (as an example).

Any suitable feed arrangements may be used for the antenna elements in antenna 22 such as the antenna elements shown in the examples of FIGS. 4, 5, 6, and 7. For example, a transmission line such as a microstrip transmission line or a coaxial cable transmission line may be connected to antenna feed terminals in an antenna element. If desired, an impedance matching network may be coupled to an antenna element (e.g., at its feed terminals).

The ground plane and antenna resonating element structures of antenna 22 may be formed from any suitable conductive materials. As an example, these antenna structures may be formed from metals such as copper, gold, alloys, etc. The conductive structures may be formed as part of case 12. Conductive antenna structures may also be formed from traces on printed circuit board structures such as rigid printed circuit boards or flex circuits. Metal wires, foils, or solid metal pieces may also be used (e.g., metal frame structures, etc.). If desired, antenna element structures for ground planes and antenna resonating elements may be formed using combinations of conductive structures such as these or other suitable conductive structures. The use of case materials, printed circuit traces, wires, foils, and solid metal pieces such as frame members is merely illustrative.

Antenna element slots such as slots 78 and 88 may be filled with a dielectric such as air or a solid dielectric such as plastic or epoxy. An advantage of filling slots 78 and 88 with a solid dielectric material is that this may help prevent intrusion of dust, liquids, or other foreign matter into portions of the antenna. When slots are formed in a flex circuit, the slots are typically filled with or placed on top of flex circuit material (polyimide). Similarly, when slots are formed from rigid printed circuit board traces, the dielectric within the slots or immediately adjacent to the slots is composed of printed circuit board dielectric (e.g., fiberglass-filled epoxy). Dielectrics such as these may also be used in support structures of antenna elements (e.g., when supporting a flex circuit antenna element), or in surrounding device structures in which it is desired not to block radio-frequency signals.

These examples are merely illustrative examples of dielectrics that can be used in antenna 22. In general, any suitable dielectric material can be used to form dielectric portions of device 10 such as the dielectrics in slots 78 and 88 and the dielectrics in support structures such as antenna support structure 48 of FIG. 3. For example, dielectric structures in antenna slots, antenna support structures, or other structures in device 10 may be formed using a solid dielectric, a porous dielectric, a foam dielectric, a gelatinous dielectric (e.g., a coagulated or viscous liquid), a dielectric with grooves or pores, a dielectric having a honeycombed or lattice structure, a dielectric having spherical voids or other voids, a combination of such non-gaseous dielectrics, etc. Dielectrics for device 10 (e.g., the dielectric in slots 78 and 88 or the dielectric surrounding part of an antenna element) can also be formed using a gaseous dielectric such as air. Hollow features in solid dielectrics may be filled with air or other gases or lower dielectric constant materials. Examples of dielectric materials that may be used in device 10 that contain voids include epoxy gas bubbles, epoxy with hollow or low-dielectric-constant microspheres or other void-forming structures, polyimide with gas bubbles or microspheres, etc. Porous dielectric materials used in device 10 can be formed with a closed cell structure (e.g., with isolated voids) or with an open cell structure (e.g., a fibrous structure with interconnected voids). Foams such as foaming glues (e.g., polyurethane adhesive), pieces of expanded polystyrene foam, extruded polystyrene foam, foam rubber, or other manufactured foams can also be used in device 10. If desired, the dielectric materials in device 10 can include layers or mixtures of different substances such as mixtures including small bodies of lower density material.

If desired, antenna elements for antenna 22 may be formed from two or more subelements. Arrangements such as this are sometimes referred to as multiarm or multibranch arrangements. Multiple antenna arms may be formed, for example, from multiple antenna slots, a group of two or more wires or other conductive paths, mixtures of slots and conductive paths, etc.

Figure 8:
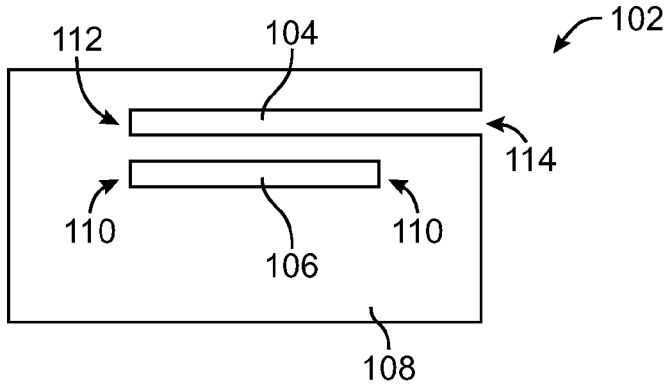
FIG. 8 is a diagram of an illustrative dual slot antenna element that may be used in an antenna in accordance with an embodiment of the present invention.

An illustrative multislot antenna structure of the type that may be used as an antenna element of antenna 22 is shown in FIG. 8. As shown in FIG. 8, antenna element 102 may have slots such as slots 106 and 104. Two slots are shown in this example, but there may, in general, be any suitable number of slots in antenna element 102 (e.g., one, two, three, more than three, etc.). Slots in element 102 may be closed or open. In the FIG. 8 example, slot 106 is a closed slot and has closed ends 110, whereas slot 104 is an open slot that has closed end 112 and open end 114. Multislot antenna elements such as antenna element 102 may have two open slots, two closed slots, mixtures of three or more closed and open slots, etc.

The slots in multislot configurations such as multislot antenna element 102 of FIG. 8 may each be configured to exhibit a different frequency resonance. For example, two closed slots of different lengths may be included in multislot antenna element 102 to provide an antenna element with two different frequency resonances. The resonant peaks associated with the slots may be close to each other (e.g., overlapping) or may be relatively far from each other. For example, two closely spaced resonant peaks may be used in situations in which the multislot antenna element is configured to cover a relatively broad communications band. Two more widely spaced resonant peaks may be used in situations in which it is desired to cover distinct first and second communications bands. Resonant peak locations can be adjusted by adjusting the lengths of the slots and by adjusting whether the slots are open or closed.

Figure 9:
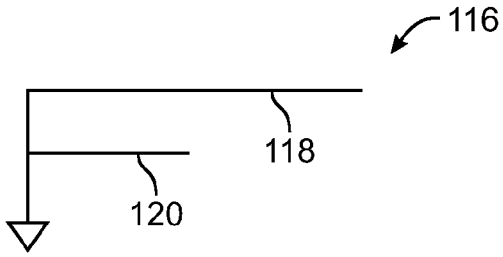
FIG. 9 is a diagram of an illustrative dual arm inverted-F antenna element that may be used in an antenna in accordance with an embodiment of the present invention.

An illustrative multiarm inverted-F antenna that may be used as an antenna element in antenna 22 of device 10 is shown in FIG. 9. As shown in FIG. 9, antenna 116 may have first arm 118 and second arm 120. The first and second arms may have different lengths. The longer arm (e.g., arm 118) will generally exhibit a frequency resonance peak at a lower communications frequency than the shorter arm (e.g., arm 120). As with slot-based antenna elements, inverted-F antenna element arms may have lengths that are selected to form two closely spaced resonant peaks (e.g., overlapping resonant peaks to handle a communications band with a wider bandwidth than can be readily handled using a single-arm structure) or may be used to form resonant peaks that are spaced farther apart (e.g., to form an antenna structure that handles two different communications bands).

Figure 10:
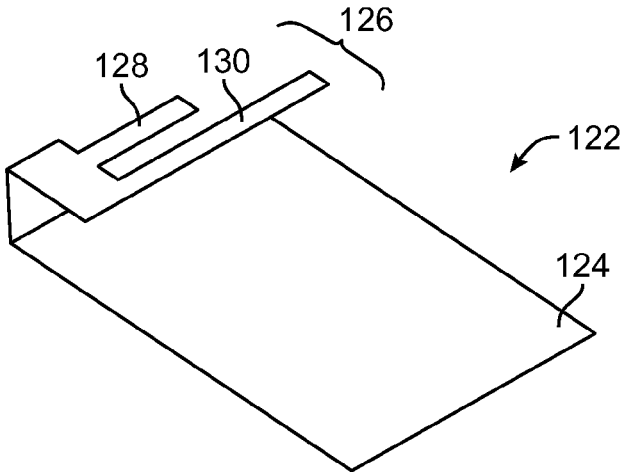
FIG. 10 is a diagram of an illustrative dual arm planar inverted-F antenna element that may be used in an antenna in accordance with an embodiment of the present invention.

An illustrative multiarm planar inverted-F antenna element that may be used as an antenna element in antenna 22 is shown in FIG. 10. As shown in FIG. 10, planar inverted-F antenna resonating element 122 may have ground plane 124 and antenna resonating element 126. Antenna resonating element 126 may include arm 128 and arm 130. Although shown as straight rectangular structures in the example of FIG. 10, arms such as arms 128 and 130 may have non-rectangular shapes, non-straight shapes, shapes with folds and bends, curved shapes, shapes with widths of different sizes, meandering path shapes, or any other suitable shapes. There may be one, two, three, or more than three arms such as arms 128 and 130 in given planar inverted-F antenna. The example of FIG. 10 is merely illustrative.

The antenna elements in antenna 22 may be used to cover a single communications band or multiple communications bands. For example, antenna 22 may be configured to cover a single IEEE 802.11 band such as the 2.4 GHz band used for IEEE 802.11(b) communications. As another example, antenna 22 may be used to cover two bands such as the 2.4 GHz and the 5 GHz IEEE 802.11 bands. Different bands may also be covered if desired.

In arrangements in which multiple communications bands are covered, one arm in a multiarm antenna element may exhibit a frequency resonance peak in a first communications band, whereas a second arm may exhibit a frequency resonance peak in a second communications band. For example, in a planar inverted-F antenna with shorter and longer arms, the shorter arm may be associated with a peak frequency resonance in a higher frequency communications band and the longer arm may be associated with a peak frequency resonance in a lower frequency communications band.

Figure 11:
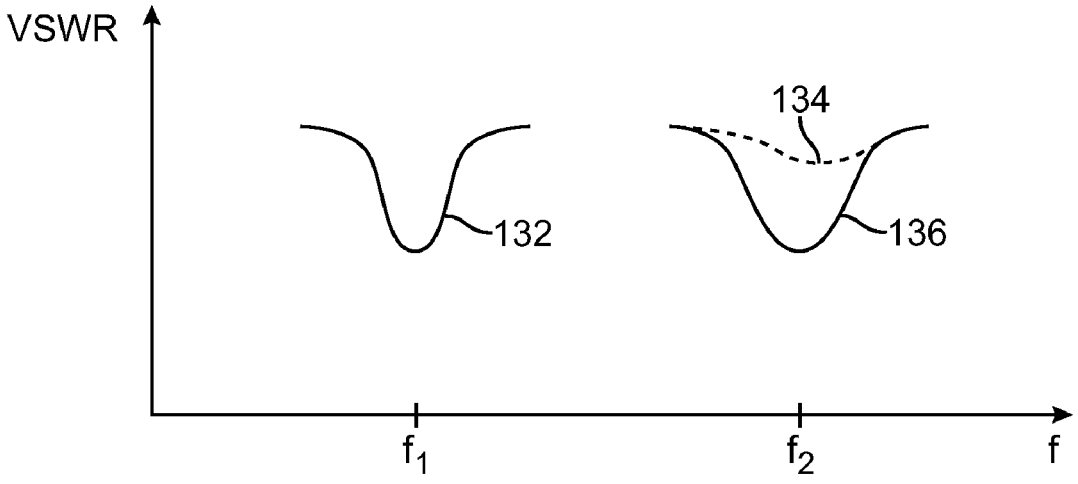
FIG. 11 is a graph showing an illustrative antenna frequency response characteristic that may be produced by a dual band antenna located in a portion of a portable electronic device housing in accordance with an embodiment of the present invention.

A graph of the expected performance of an antenna element that has been designed to cover first and second communications bands in this way is shown in FIG. 11. In the graph of FIG. 11, expected voltage standing wave ratio (VSWR) values for the antenna element are plotted as a function of frequency. The performance of the antenna is given by solid lines 132 and 136. As shown by solid line 132, there is a reduced VSWR value at frequency $f_1$, indicating that the antenna performs well in the frequency band centered at frequency $f_1$. This frequency peak may be associated with the longer of two antenna resonating element arms. This longer arm may also operate at harmonic frequencies such as a frequency near frequency $f_2$, as indicated by dashed line 134. In this example, frequency $f_2$ is slightly below, but close to the second harmonic of the longer antenna arm (i.e., $f_2 \approx 2f_1$). The shorter arm has been configured to resonate at frequency $f_2$. Together, the second harmonic of the longer arm (line 134) and the fundamental resonance of the shorter arm exhibit the combined behavior of line 136.

The dimensions of the antenna may be selected so that frequencies $f_1$ and $f_2$ are aligned with communication bands of interest. For example, in a planar inverted-F antenna having first and second arms such as shorter arm 128 and longer arm 130 of FIG. 10, the frequency $f_1$ (and its harmonic frequency $2f_1$) will be related to the length of longer arm 130 (i.e., the length of arm 130 will be approximately equal to one quarter of a wavelength at frequency $f_1$), whereas the frequency $f_2$ will be related to the length of shorter arm 128 (i.e., the length of arm 128 will be approximately equal to one quarter of a wavelength at frequency $f_2$). Inverted-F antennas with arms of dissimilar lengths may exhibit the same type of behavior.

In multislot antennas formed from slots of the same type (i.e., both open slots or both closed slots), the shorter slot will be associated with frequency $f_2$ and the longer slot will be associated with frequency $f_1$. Antennas with both open and closed slots may also be used. In type of arrangement, an open slot may be associated with the communications band at frequency $f_1$ (i.e., the open slot may have a length approximately equal to one quarter of a wavelength at frequency $f_1$) and a closed slot may be associated with the communications frequency at frequency $f_2$ (i.e., the closed slot may have a length approximately equal to one half of a wavelength at frequency $f_1$).

Arrangements with mixtures of slots and inverted-F or planar inverted-F antenna arms may also be used. The slots and other arms may be configured to cover two bands (e.g., communications bands such as bands associated with the frequency peaks at $f_1$ and $f_2$ in the FIG. 11 example) or more than two bands. In an illustrative two-band configuration, frequency $f_1$ might correspond to a 2.4 GHz IEEE 802.11 band and frequency $f_2$ might correspond to a 5 GHz IEEE 802.11 band (as an example). In a first antenna element in antenna 22 (e.g., antenna resonating element 22A), the first (2.4 GHz) band may be associated with a resonance produced by a first planar inverted-F arm such as arm 130 and the second (5 GHz) band may be associated with a resonance produced by a second planar inverted-F arm such as arm 128. In a second antenna element in the same antenna 22 (e.g., antenna resonating element 22B), the first (2.4 GHz) band may be associated with a resonance produced by a planar inverted-F arm and the second (5 GHz) band may be associated with a resonance produced by a slot (e.g., a closed slot).

Figure 12:
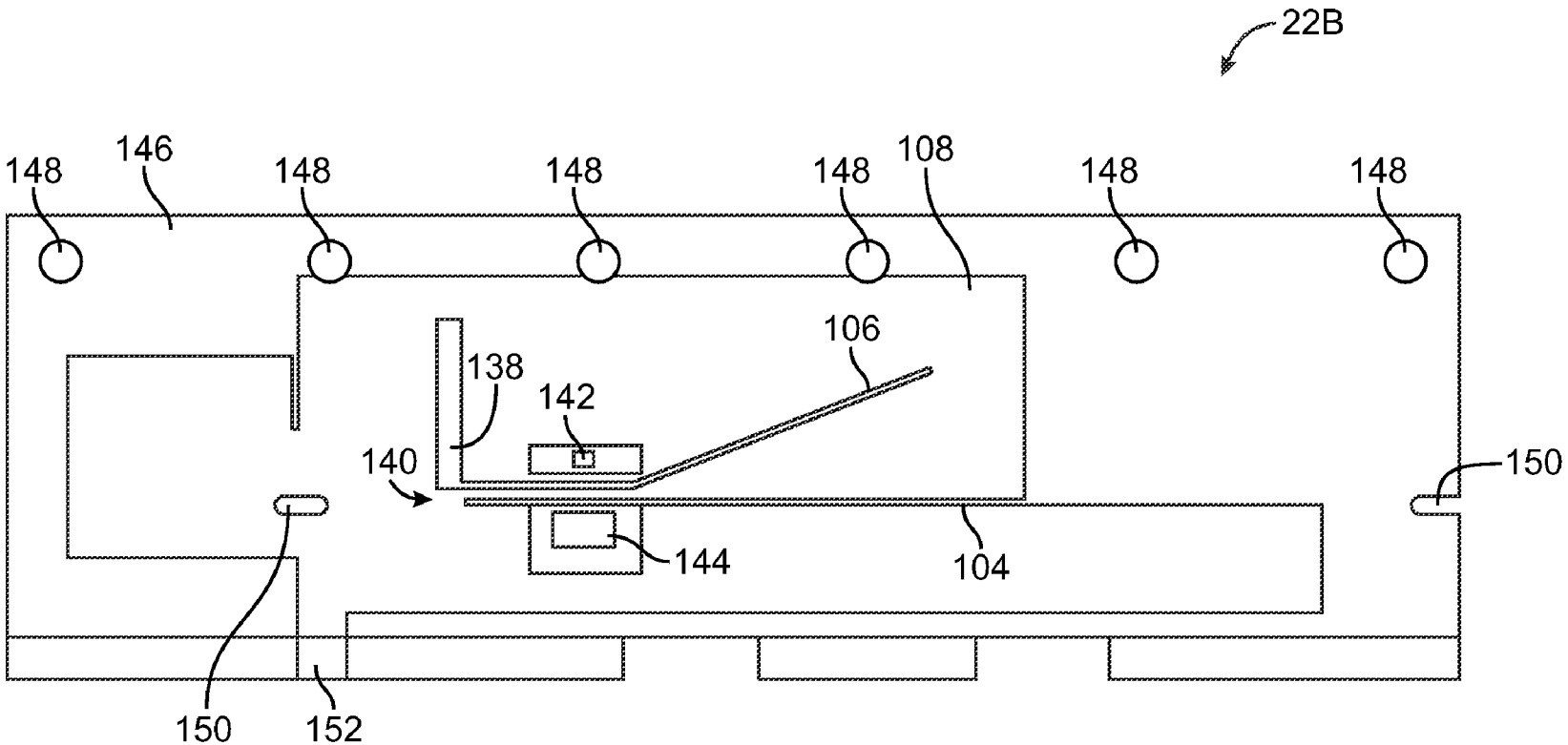
FIG. 12 is a diagram of an illustrative dual slot antenna that may be used as a first antenna element in a dual antenna element structure in a portion of a portable electronic device housing in accordance with an embodiment of the present invention.

An illustrative two slot antenna element 22B that may be used in antenna 22 is shown in FIG. 12. In the example of FIG. 12, antenna element 22B has two slots. Slot 104 is an open slot and may be used to cover the 2.4 GHz IEEE 802.11 band. Slot 106 is a closed slot and may be used to cover the 5 GHz IEEE 802.11 band. Slot 104 may be substantially straight. Slot 106 may have a bend 140 and an enlarged section 138 that helps to broaden the bandwidth of the frequency contribution from slot 106 to the performance of antenna element 22B. Antenna element 22B may be fed using, for example, a transmission line that is coupled to feed terminals 142 and 144. An impedance matching network may be used to help match the impedance of the transmission line to the impedance of antenna element 22B. Ground plane 108 may be formed from a patterned conductive trace such as a metal trace. The metal trace may be formed on a flex circuit substrate such as polyimide 146.

Holes 148 may be provided in substrate 146. Holes 148 may receive alignment posts in an antenna support structure such as antenna support structure 48 of FIG. 3. Slots 150 may also serve as alignment features that help to properly orient flex circuit substrate 146 to support structure 48. In regions such as region 152, antenna element 22B may be provided with traces and/or conductive foam to help electrically connect trace 108 to a conductive frame or other suitable portion of housing 12 in device 10. If desired, other conductive structures such as springs, pins, solder connections, fasteners, or other conductive members may be used in place of conductive foam or in addition to conductive foam when shorting antenna element 22A to the frame or other ground structures of device 10.

Figure 13:
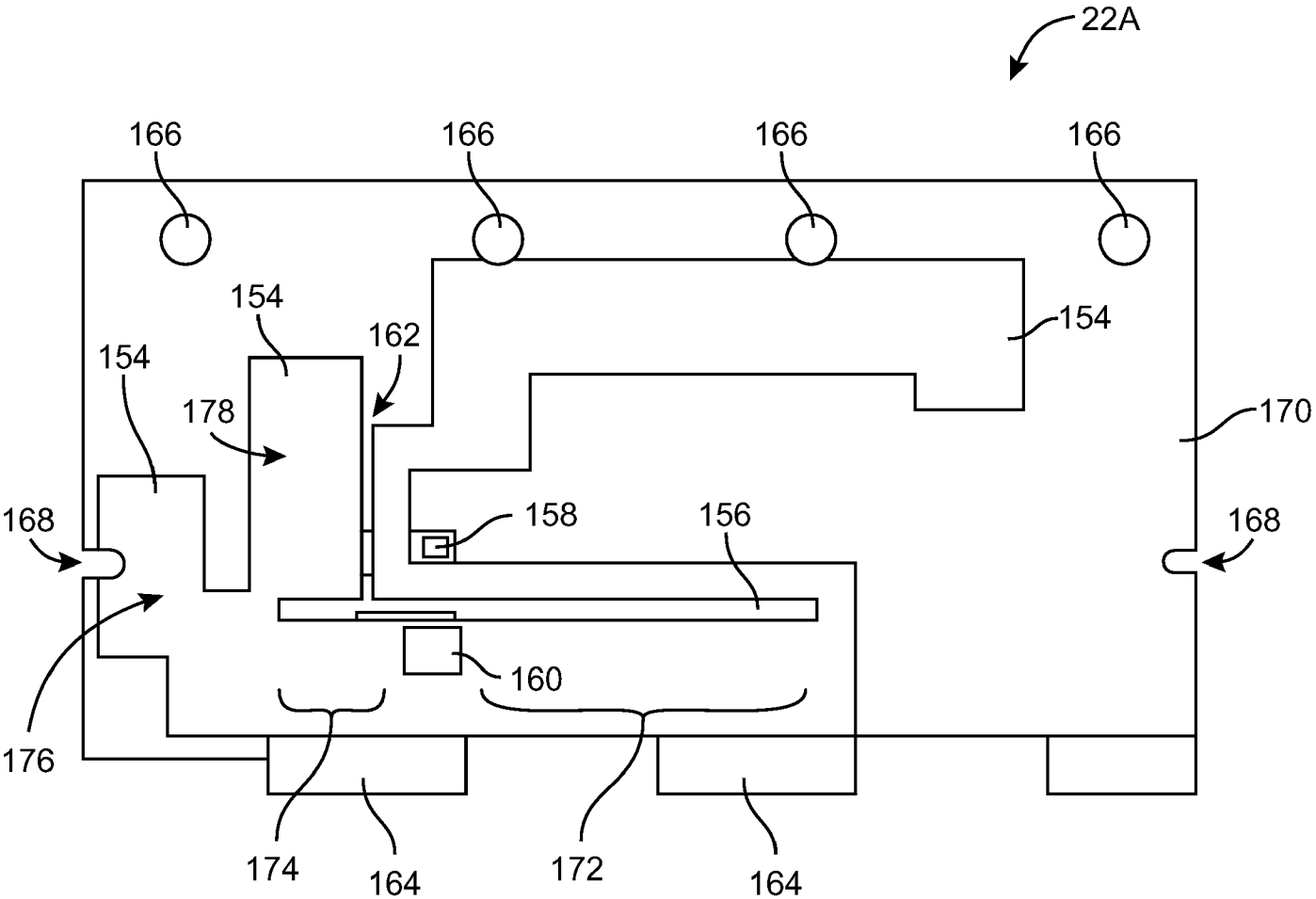
FIG. 13 is a diagram of an illustrative dual band hybrid antenna having a planar inverted-F antenna resonating element and a slot and that may be used as a second antenna element in a dual antenna element structure that uses an antenna element of the type shown in FIG. 12 as a first antenna element in accordance with an embodiment of the present invention.

An illustrative hybrid element 22A that is based on a planar inverted-F antenna (PIFA) arm in combination with a slot (i.e., a hybrid PIFA-slot antenna element) is shown in FIG. 13. Antenna element 22A of FIG. 13 may be used in conjunction with antenna 22B of FIG. 12 in an antenna such as antenna 22 of FIG. 3. Because antenna element 22B is of a first type (a dual-slot architecture), whereas antenna element 22A is of a second type (a hybrid PIFA-slot architecture), the antenna performance characteristics of the two antenna elements differ, helping to decrease directivity and enhance performance (e.g., for MIMO applications).

As with antenna element 22B of FIG. 12, antenna element 22A of FIG. 13 may be formed from a conductive trace on a flex circuit substrate (substrate 170). In the example of FIG. 13, antenna element 22B has an arm 154 that forms a planar antenna resonating element (i.e., a PIFA resonating element) for antenna element 22B. Arm 154 may be formed from a conductive trace on substrate 170 (e.g., a trace on the outermost surface of substrate 170 or a trace formed within an inner layer of substrate 170). Arm 154 may be bent and may have protrusions that help form a slot and that tune antenna performance characteristics. Substrate 170 may be, for example, a flex circuit substrate (e.g., a polyimide film substrate).

Slot 156 may be a substantially closed slot whose shape is defined by the locations of the edges of arm 154. The lengths of arm 154 and slot 156 may be selected to cover the 2.4 GHz and 5 GHz IEEE 802.11 bands. For example, arm 154 may be used to cover a lower-frequency communications band such as the band at frequency $f_1$ in FIG. 11 (e.g., 2.4 GHz), whereas slot 104 may be used to cover a higher-frequency communications band such as the band at frequency $f_2$ in FIG. 11 (e.g., 5 GHz). Antenna element 22A may be fed using antenna feed terminals 158 and 160. A transmission line such as a coaxial transmission line or microstrip transmission line may be coupled to feed terminals 158 and 160. An impedance matching network may be used to help match the impedance of the transmission line connected to terminals 158 and 160.

Portion 172 of slot 156 to the right of feed terminals 158 and 160 in FIG. 13 may serve as the primarily radiator section of slot 156. The input impedance of slot 156 may be mainly inductive. A thin capacitive gap such as gap 162 may be included in antenna element 22A to add capacitance to stub portion 174 of slot 156 to the left of feed terminals 158 and 160. The capacitance added to portion 174 of slot 156 may help neutralize the inductive characteristic of portion 172 of slot 156, thereby creating a net resonant condition for the slot antenna structure.

As shown in FIG. 13, the width of the trace of arm 154 may be fairly wide, as this helps to improve the bandwidth coverage of arm 154. The relatively large width of arm 154 may also help to ensure that the second harmonic of arm 154 (e.g., $2f_1$) coincides with the frequency $f_2$ (e.g., 5 GHz) that is being covered by slot 156. Portions 176 and 178 of arm 154 may help tune the impedance and frequency coverage of antenna 22A.

Substrate 170 may be provided with holes such as holes 166. When substrate 170 is mounted to an antenna support structure such as support structure 48 of FIG. 3, holes 166 may mate with alignment posts. The alignment posts may be deformed during assembly using a heat staking process to help secure antenna element 22A to support 48. Slots such as slots 168 and other alignment features may be used to help align substrate 170 relative to support 48.

In regions such as regions 164, conductive structures may be used to help electrically connect the conductive traces of antenna 22A to conductive ground structures in device 10 such as frame structures. Conductive structures 164 may be formed from conductive foam, fasteners, springs, or other suitable conductive members.

Antenna performance in device 10 can be enhanced when forming a clutch barrel antenna 22 using antenna elements of different types such as antenna element 22B of FIG. 12 and antenna 22A of FIG. 13. Antenna 22B of FIG. 12 is a dual slot antenna and exhibits good performance in the 2.4 GHz and 5 GHz IEEE 802.11 bands. When placed within clutch barrel 38, antenna element 22B provides a perpendicular polarization relative to conductive base 14 and cover 16, and forms a horn antenna with good measured performance. If two identical elements 22B are used in antenna 22 in clutch barrel 38, the directivity of the antenna might be fairly large. The use of an antenna element 22A of a different type than antenna element 22B helps to ensure that the directivity exhibited by antenna 22 is not too high for 802.11b/g operations. In particular, when an antenna element such as the hybrid PIFA-slot antenna element 22A of the type shown in FIG. 13 is used in combination with a dual-slot antenna element such as antenna element 22B of FIG. 12, measured directivity (e.g., the gain as a function of orientation) is within acceptable regulatory limits and is satisfactory for dual band IEEE 802.11 applications. This is because the hybrid PIFA-slot antenna element 22A exhibits different antenna characteristics (e.g., a different polarization and gain pattern) than dual slot antenna element 22B. Antenna element 22A creates a cross-polarization relative to antenna element 22B due to its use of arm 154 (i.e., a wire-type structure) as opposed to the slots of antenna element 22B. The cross-polarization radiation associated with arm 154 helps to reduce the overall directivity of antenna 22, because a split beam (difference beam) can form at its aperture, thereby spreading radiation evenly and avoiding the formation of sharp directional peaks. The cross-polarization produced by arm 154 of antenna element 22A at 2.4 GHz is generally orthogonal to that of antenna 22B, but is not destructive, giving rise to satisfactory performance for the clutch barrel antenna.

As this example demonstrates, when two different types of antenna element are used in forming a multielement antenna such as clutch barrel antenna 22, performance can be enhanced relative to configurations in which a single type of antenna element is used for both of the antenna elements. Each antenna element may, in general, be formed using any suitable architecture (e.g., slot-based, hybrid, inverted-F, planar inverted-F, etc.).

With one suitable arrangement for antenna 22, antenna 22 has multiple antenna elements (e.g., two or more antenna elements). In the FIG. 3 example, antenna 22 is shown as having two antenna elements 22A and 22B. With this type of configuration, the first antenna element (e.g., antenna element 22A) may be, for example, an inverted-F antenna element such as a single-arm or multiple arm element (e.g., antenna 50 of FIG. 4 or antenna 116 of FIG. 9), a planar inverted-F antenna element (e.g., planar inverted-F antenna element 62 of FIG. 5 or planar inverted-F antenna element 122 of FIG. 10), a slot antenna (e.g., slot antenna 74 of FIG. 6, slot antenna 84 of FIG. 7, or slot antenna 102 of FIG. 8), or a hybrid antenna (e.g., a PIFA-slot antenna as shown in FIG. 13). The second antenna element (e.g., antenna element 22B) and any optional additional antenna elements may be selected from the same group of antenna types. Performance will generally be improved when antenna elements of different types are used in antenna 22, but two or more of the antenna elements in a given antenna 22 may, if desired, be implemented using the same type of antenna.

Antenna elements such as antenna element 22A of FIG. 13 and antenna element 22B of FIG. 12 may be mounted within clutch barrel 38 or other portion of device 10 using any suitable arrangement. Illustrative mounting arrangements are shown in FIGS. 14, 15, 16, 17, and 18.

Figure 14:
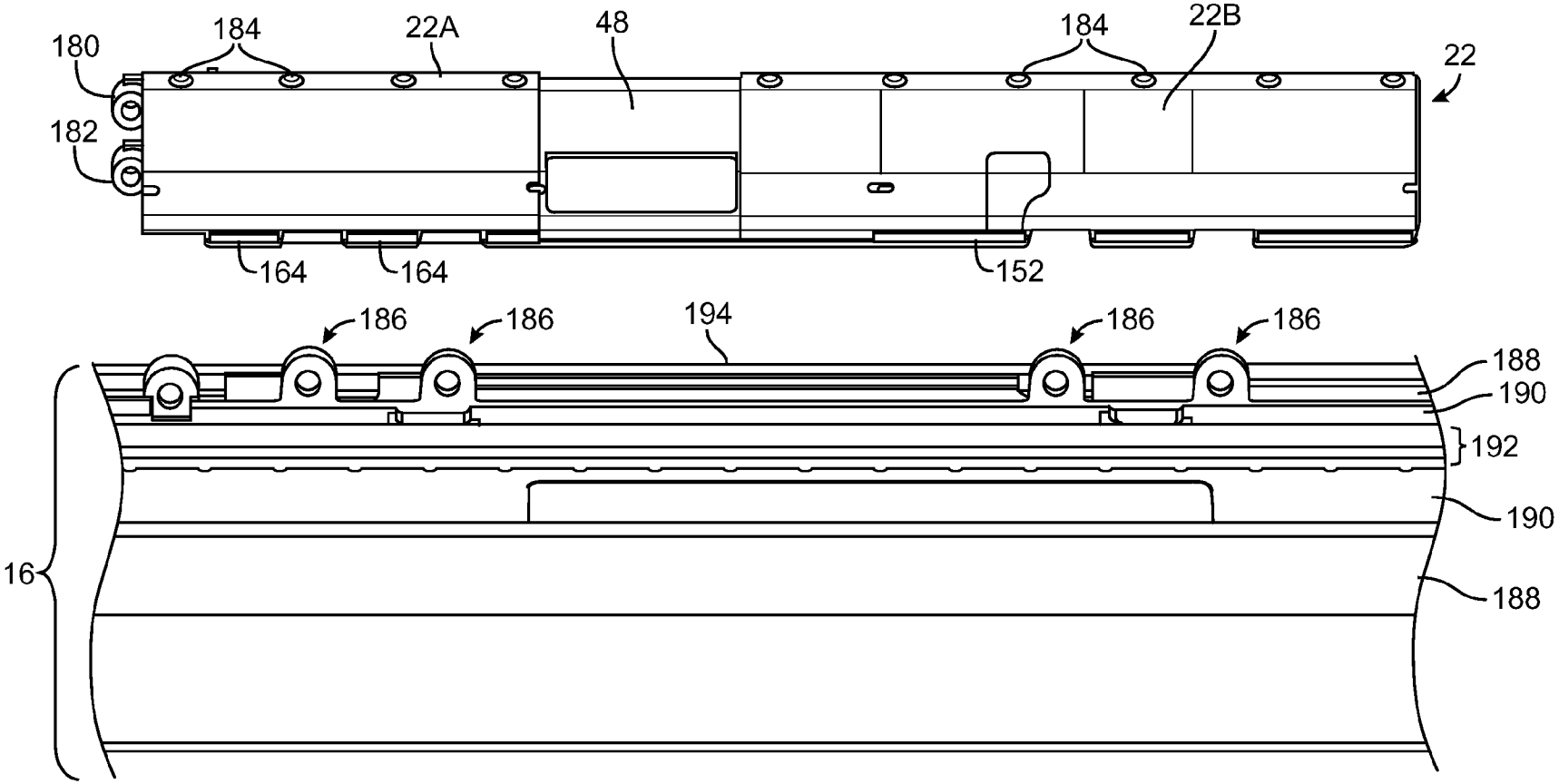
FIG. 14 is an exploded perspective view of a portion of a portable electronic device housing and associated antenna structures in accordance with an embodiment of the present invention.

An exploded perspective view of antenna 22 in the vicinity of housing portion 16 is shown in FIG. 14. As shown in FIG. 14, housing 16 may include a cover such as cover portion 188. Cover 188 may be a sheet of metal that serves as the outer cover layer for upper housing portion 16 (e.g., the lid of device 10). Metal support structures such as frame 190 may be mounted within metal layer 188. An elastomeric member such as gasket 192 may be mounted to frame 190. A display such as a liquid crystal display may be mounted in upper housing portion 16. When mounted, gasket 192 may help to prevent the display from bearing against edge 194 of housing layer 188 and the inner portion of frame 190. Because frame 190 may be used in mounting a display, frame 190 is sometimes referred to as a display frame.

Frame 190 may have holes 186 that mate with corresponding holes in antenna support 48. Coaxial cable connectors may be connected to antenna 22 at attachment locations 180 and 182. The coaxial cable connectors may be, for example, UFL connectors. One connector may be used to route signals to antenna element 22A and another connector may be associated with radio-frequency signals for antenna element 22B. Conductive foam or other suitable conductive structures may be used to ground antenna 22 to housing 16. For example, conductive foam at ground locations 164 and 152 may be used to ground antenna 22 to frame 190. Frame 190 may be shorted to case 188, so this arrangement may help to ground antenna 22 to housing portion 16 and housing 12. During operation of antenna 22, conductive portions of housing 12 can serve as antenna ground. Heat stakes 184 may be used to align flex circuits 22A and 22B to antenna support structure 48.

Figure 15:
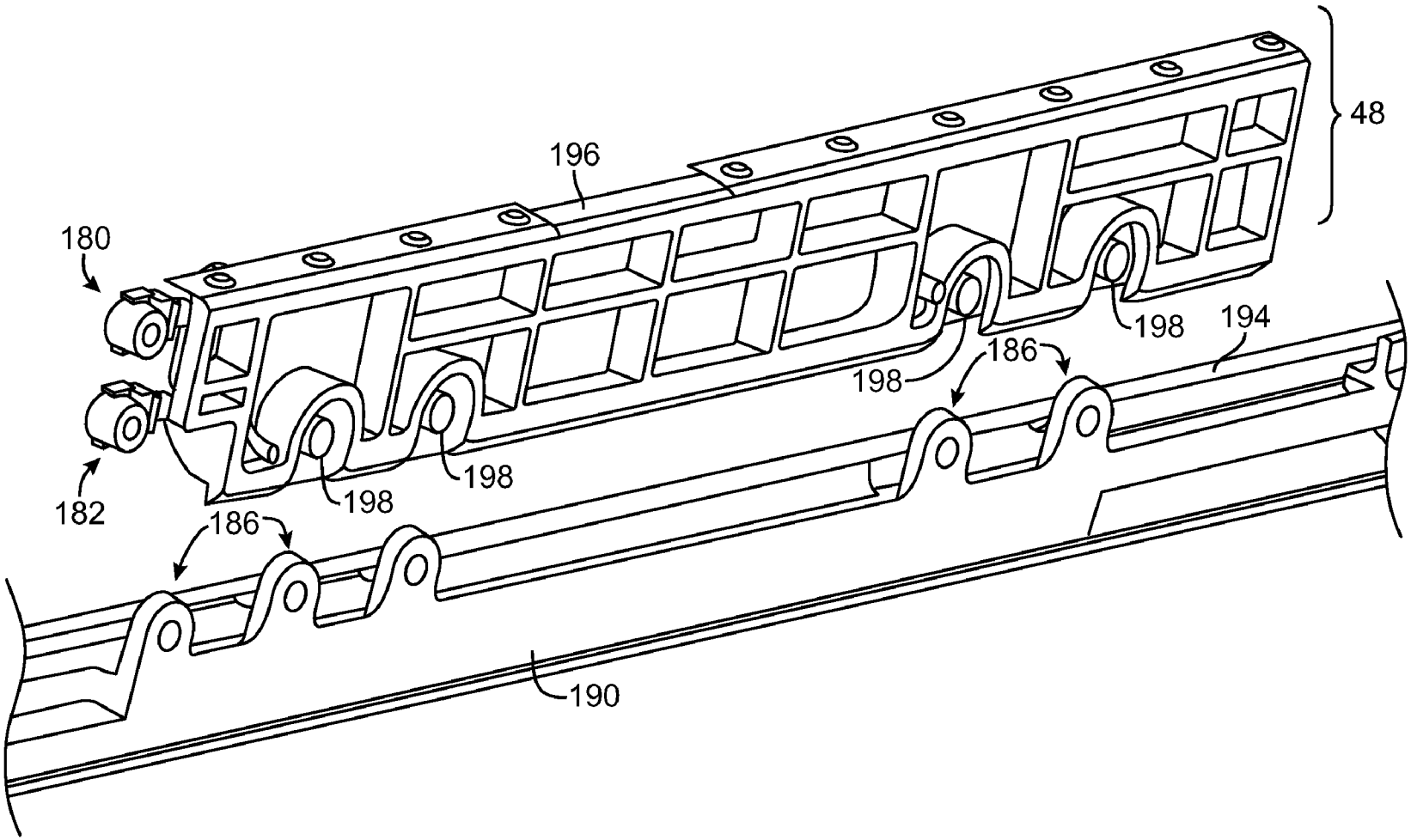
FIG. 15 is an exploded perspective view of a portion of a portable electronic device housing and a rib structure that may be used in an antenna support portion of a multielement antenna in accordance with an embodiment of the present invention.

FIG. 15 shows how antenna support structure 48 may have a ribbed internal support member such as member 196. The ribs of member 196 may, if desired, be formed as an integral portion of antenna support structure 48. Antenna support structure 48 may also be formed from multiple parts that are joined together (e.g., multiple plastic parts such as ribbed supports, support surfaces, etc.). Screw holes 198 may mate with corresponding screw holes 186. Holes such as holes 198 and 186 may be used to screw support member 196 of antenna support 48 to frame 190. Holes 186 may be threaded to accept screws that pass through holes 198.

Figure 16:
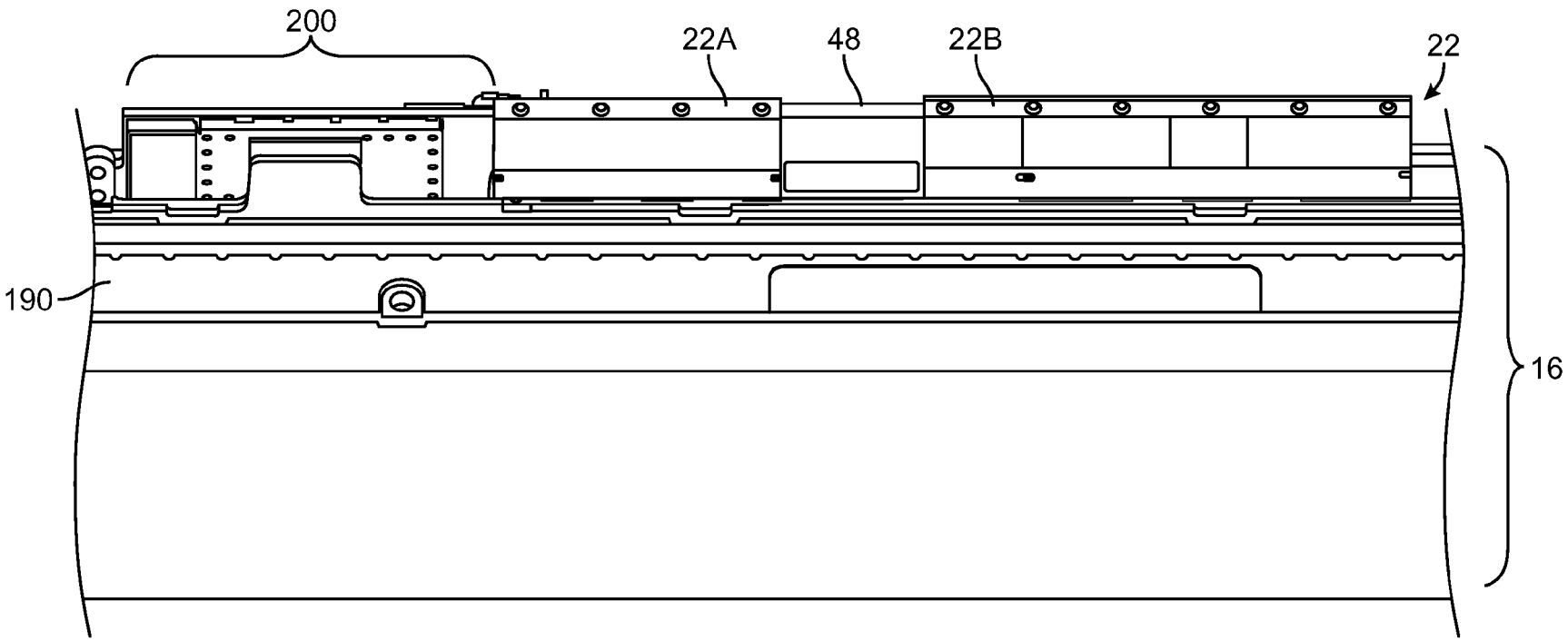
FIG. 16 is a perspective view of an antenna structure of the type shown in FIG. 14 when installed on a portion of a housing of a portable electronic device in accordance with an embodiment of the present invention.

FIG. 16 is a perspective view similar to that of FIG. 14, but showing antenna 22 mounted to housing portion 16. As shown in FIG. 16, circuitry 200 may be mounted to the end of antenna support structure 48. Circuitry 200 may include radio-frequency circuitry such as transceiver circuitry and discrete components. Signals may be conveyed between circuitry 200 and a main logic board (e.g., a logic board in lower housing 14) using a digital signal path or other suitable communications path.

Figure 17:
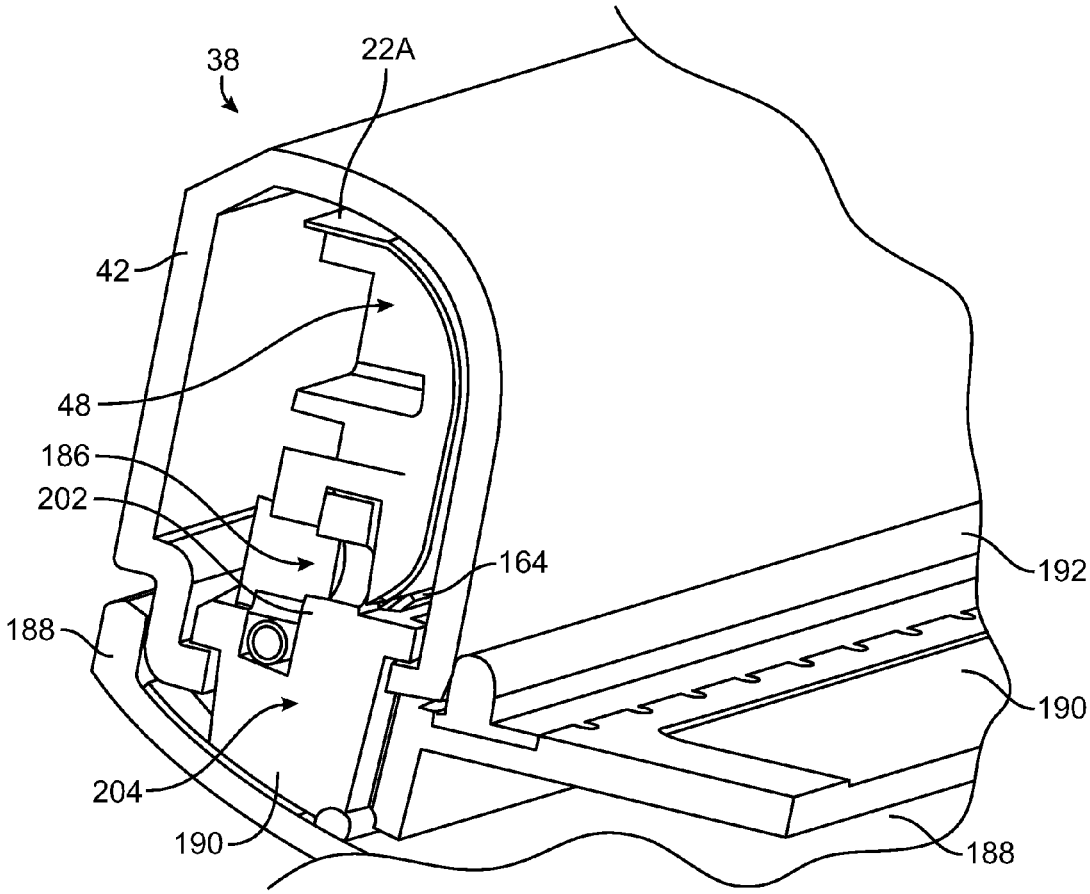
FIG. 17 is a cross-sectional end view of a portion of a clutch barrel in a portable computer that contains an antenna in accordance with an embodiment of the present invention.

Circuitry 200 and antenna 22 have an elongated shape that allows these components to be mounted within clutch barrel 38 of device 10 (FIG. 1). In the view depicted in FIG. 16, clutch barrel cover 42 is not shown, so that the interior components of clutch barrel 38 are not obstructed from view. Clutch barrel cover 42 is shown in the cross-sectional view of clutch barrel 38 in FIG. 17. As shown in FIG. 17, clutch barrel cover 42 may encase and surround antenna support structure 48 (including ribs 196 of FIG. 15). Antenna elements 22A and 22B, which are supported on the outer surface of antenna support structure 48, are also covered by clutch barrel cover 42. To ensure that the operation of antenna 22 is not blocked by the presence of cover 42, clutch barrel cover 42 may be formed from a dielectric such as plastic.

As shown in FIG. 17, the lower portion of clutch barrel cover 42 may have an opening such as opening 204 that runs along substantially the entire length of clutch barrel cover 42. Opening 204 allows conductive housing portions such as portions 202 of display frame 190 to protrude into the interior of clutch barrel 38. These conductive members may serve as antenna ground for antenna 22 and may be electrically connected to the conductive traces of the flex circuit antenna elements mounted to support 48 using conductive members such as conductive foam 164.

Figure 18:
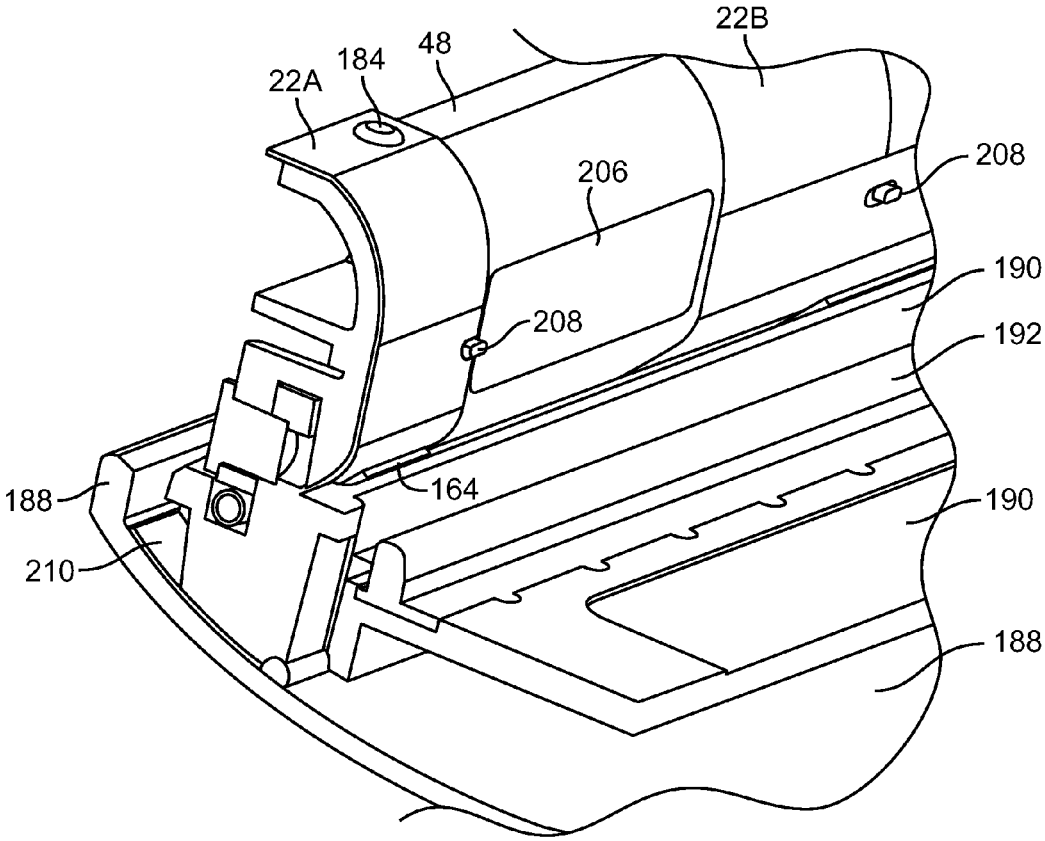
FIG. 18 is a cross-sectional end view of a portion of a clutch barrel from which the cover of the clutch barrel has been removed and that contains an antenna in accordance with an embodiment of the present invention.

FIG. 18 is a cross-sectional perspective view of clutch barrel 38 that is similar to the view of FIG. 17. In the drawing of FIG. 18, clutch barrel cover 42 has been removed so as not to obscure antenna elements 22A and 22B. As shown in FIG. 18, a label such as label 206 may be affixed to antenna support structure 48. Heat staked alignment posts such as post 184 may be used to attach antenna element flex circuit structures to support 48. Alignment posts such as posts 208 may mate with alignment features in antenna elements 22A and 22B, such as notches 168 of antenna element 22A (FIG. 13) and openings 150 of antenna element 22B (FIG. 12). Adhesive film (e.g., double-sided tape) such as adhesive 210 may be used in attaching housing frame 190 to housing cover metal layer 188.

The foregoing is merely illustrative of the principles of this invention and various modifications can be made by those skilled in the art without departing from the scope and spirit of the invention.

What is claimed is:

1. Clutch barrel antenna structures in the clutch barrel of a laptop computer, comprising:

a singular clutch barrel antenna support structure in the clutch barrel; and at least first and second antenna elements of different types mounted to the singular antenna support structure that form a clutch barrel antenna, wherein the first antenna element comprises at least first and second slots.

2. The clutch barrel antenna structures defined in claim 1 wherein the second antenna element is of a type selected from the group of antenna types consisting of: a planar inverted-F antenna (PIFA), an inverted-F antenna, a slot antenna, and a hybrid PIFA-slot antenna.

3. The clutch barrel antenna structures defined in claim 2 wherein the first slot in the first antenna element comprises a closed slot and wherein the second slot comprises an open slot.

4. The clutch barrel antenna structures defined in claim 3 wherein the second antenna element comprises at least one slot.

5. The clutch barrel antenna structures defined in claim 3 wherein the second antenna element comprises a PIFA-slot hybrid antenna element having a slot and a planar antenna resonating element arm.

6. The clutch barrel antenna structures defined in claim 5 wherein the first and second antenna elements comprise flex circuit antenna elements.

7. The clutch barrel antenna structures defined in claim 1 wherein the first antenna element comprises a dual slot flex circuit antenna element and wherein the second antenna element comprises a hybrid antenna having a planar-inverted-F antenna resonating element arm and a slot.

8. The clutch barrel antenna structures defined in claim 1 wherein the clutch barrel comprises a plastic clutch barrel cover that surrounds the clutch barrel and wherein the first and second antenna elements comprise flex circuits mounted within the clutch barrel cover.

9. The clutch barrel antenna structures defined in claim 1 wherein the first antenna element operates in first and second communications bands and wherein the second antenna element contains only a single slot and operates in the first and second communications bands.

10. The clutch barrel antenna structures defined in claim 1 wherein the first antenna element is a dual band antenna that operates in 2.4 GHz and 5 GHz bands and wherein the second antenna element is a dual band antenna that operates in the 2.4 GHz and 5 GHz bands.

11. A dual band antenna system comprising:

a first dual band antenna element that operates in first and second communications bands and that has first and second slots;

a second dual band antenna element that operates in the first and second communications bands and is of a hybrid type having a planar inverted-F antenna resonating element arm and a resonating element formed from a slot, wherein the first dual band antenna element and the second dual band antenna element are flex circuit antenna elements; and a singular clutch barrel antenna support structure to which the first dual band antenna element and the second dual band antenna element are mounted.

12. The dual band antenna system defined in claim 11 wherein the singular clutch barrel antenna support structure is mounted within the clutch barrel of a portable computer.

13. A portable wireless electronic device, comprising:

an upper housing that has a display;

a lower housing that is attached to the upper housing by a hinge;

a clutch barrel associated with the hinge, the clutch barrel having a dielectric clutch barrel cover; and an antenna system formed within the clutch barrel cover, wherein the antenna system has first and second antenna elements of different types and wherein the first and second antenna elements are mounted to a singular portion of the clutch barrel that rotates with respect to the lower housing.

14. The portable wireless electronic device defined in claim 13 wherein the upper housing has a metal layer and wherein the display is mounted within the metal layer.

15. The portable wireless electronic device defined in claim 14 wherein the first antenna element comprises a dual band antenna element that operates in first and second communications bands and wherein the second antenna element comprises a dual band antenna element that operates in the first and second communications bands.

16. The portable wireless electronic device defined in claim 15 wherein the first antenna element comprises an open slot and a closed slot and wherein the open slot and the closed slot have different lengths.

17. The portable wireless electronic device defined in claim 16 wherein the second antenna element comprises a slot that operates in the first communications band and a planar conductive arm that operates in the second communications band.

18. The portable wireless electronic device defined in claim 17 wherein the second antenna element comprises a capacitive gap that adjusts an impedance associated with the slot in the second antenna element, wherein the arm comprises edges that define a shape for the slot in the second antenna element.

* * * * *